US009557140B2

(12) United States Patent
Gunnarsson et al.

(10) Patent No.: US 9,557,140 B2
(45) Date of Patent: Jan. 31, 2017

(54) SIGHT

(75) Inventors: Kjell Gunnarsson, Höör (SE); Ralf Wiklund, Ödåkra (SE); Håkan Håkansson, Lund (SE)

(73) Assignee: Aimpoint AB, Malmö (SE)

( * ) Notice: Subject to any disclaimer, the term of this patent is extended or adjusted under 35 U.S.C. 154(b) by 541 days.

(21) Appl. No.: 12/019,196

(22) Filed: Jan. 24, 2008

(65) Prior Publication Data

US 2009/0188976 A1 Jul. 30, 2009

(51) Int. Cl.
*F41G 1/30* (2006.01)
*F41G 1/48* (2006.01)
*F41G 3/06* (2006.01)

(52) U.S. Cl.
CPC . *F41G 1/30* (2013.01); *F41G 1/48* (2013.01); *F41G 3/065* (2013.01)

(58) Field of Classification Search
CPC ..... F41G 3/06; F41G 1/38; F41G 1/473; F41G 3/02; F41G 1/00; F41G 1/44; F41G 1/54; F41G 3/08; F41G 3/00; F41G 1/387; F41G 1/01; F41G 1/033; F41G 1/12; F41G 3/2655; F41G 3/12; F41G 1/30; F41G 3/2627; F41G 3/2633; F41G 3/2694; G02B 27/32; G02B 27/36; G02B 23/14
USPC .... 235/454, 404; 42/132, 119, 123; 359/399
See application file for complete search history.

(56) References Cited

U.S. PATENT DOCUMENTS 4,723,160 A * 2/1988 Connelly ..... 348/115
7,225,578 B2 6/2007 Tai
7,307,793 B2 * 12/2007 Ottney et al. ..... 359/634
7,703,679 B1 * 4/2010 Bennetts et al. ..... 235/454
2003/0177685 A1 * 9/2003 Pinkley ..... F41G 1/44 42/135
2005/0198885 A1 9/2005 Staley, III
2005/0210728 A1 * 9/2005 Smith, III ..... 42/122
2005/0225853 A1 * 10/2005 Hakansson et al. ..... 359/399
2005/0233284 A1 * 10/2005 Traykov et al. ..... 434/16
2005/0252062 A1 * 11/2005 Scrogin et al. ..... 42/119
2006/0162226 A1 * 7/2006 Tai ..... 42/132
2007/0056203 A1 3/2007 Gering et al.
(Continued)

FOREIGN PATENT DOCUMENTS

EP 1 762 811 A1 3/2007
WO WO 2004/001324 12/2003

OTHER PUBLICATIONS

International Search Report and Written Opinion for PCT/EP2009/050503 mailed Jun. 8, 2009, 12 pgs.

*Primary Examiner* — Thien T Mai
(74) *Attorney, Agent, or Firm* — Merchant & Gould P.C.

(57) ABSTRACT

A self-compensating weapon sight includes
a housing,
partially reflective optics, through which a user may observe a target and receive visually displayed information simultaneously,
a light source, for visualization of an aiming point to the user via the partially reflective optics,
means for receiving a measure of the distance to the target
a processor, for determining the adequate position of the aiming point, based on the distance to the target, and for controlling the light source to emit light so that the aiming point is visualized at the adequate position,
wherein the light source is an array capable of selectively emitting light in well defined locations on its surface.

18 Claims, 4 Drawing Sheets

(56) References Cited

U.S. PATENT DOCUMENTS

2009/0100735 A1* 4/2009 Schick et al. ..... 42/123

* cited by examiner

SIGHT

FIELD OF THE INVENTION

The present invention relates to a sight, and in particular to a sight adapted for use with a weapon firing ammunition with a relatively high trajectory, such as an underslung grenade launcher (UGL) or firing with low-trajectory ammunition at longer distances. The invention also relates to a method of displaying an aiming point and to a computer program for executing said method.

TECHNICAL BACKGROUND

When using ammunition with low exit velocity, high trajectory or firing at targets at a significant distance, where the time of flight is significant, the weapon sight has to have certain properties. In such conditions the barrel of the weapon needs to have a considerable elevation in order for the ammunition to reach the target. A normal sight will generally not suffice, since it is difficult or impossible to have a visual contact with the target via the sight and at the same time have the correct inclination of the barrel, thus aiming is impossible. In this context it should be clarified that some weapons/ammunitions have an inherent high trajectory, while others only have high trajectory when applied under certain conditions, e.g. ammunition normally following a level trajectory in shorter ranges will generally fall within the definition of high trajectory if the distance they travel to the target is considerable. For the purpose of the present invention this is the relevant definition of high trajectory.

The known solution to the above problem has been to incorporate an iron sight, similar to those used for historical long guns, with a foldable primary part including distance markings, e.g. tang sight or ladder sight, such that if the distance is known, the correct distance marking can be used. This type of sight is still used, since it provides a rugged, simple solution.

More elaborate solutions include advanced optics, mechanics and computer software for calculating optimal aiming, and movement of a physical light-source inside the sight (see e.g. WO2004001324).

Though functional, more elaborate solutions generally are too complicated and thus not as rugged as one would prefer for field use or too heavy to be handheld with maintained user friendliness. The existence of moving parts inside the sight generally also increase power consumption, increase the response time, and makes the sight less versatile.

SUMMARY OF THE INVENTION

When using high-trajectory ammunition in a field condition it is obviously important to maintain an elevated awareness regarding the events in the surroundings. Therefore it is beneficial and desired to have a sight that does not include optics or electronics distorting the field of view, e.g. an optical or electronic system that creates a real or imaginary image of the target which is not in the line of sight between the aiming eye of the user and the actual target. Also, it is beneficial to be able to look at the target with the other eye while aiming.

The present invention aims at alleviating or eliminating the above and previously mentioned drawbacks and achieving the above benefits by the provision of a sight in accordance with claim 1, and a method of displaying an aiming point in accordance with claim 9 and a computer program in accordance with claim 13 Further embodiments are defined in the dependant claims.

It should be noted that even though the present sight is especially well adapted for the purposes mentioned in the introduction, it may be used on any weapon to increase precision and first shot accuracy. It should also be noted that though the inventive sight has been described by specific embodiments, it is, unless technically unfeasible, possible to add, remove or combine individual technical features of the sight to create new embodiments, not described. This is particularly true for the features defined in the appended claims.

To this end an inventive self-compensating weapon sight comprises:

a housing; partially reflective optics, through which a user may observe a target and receive visually displayed information simultaneously; a light source, for visualization of an aiming point to the user via the partially reflective optics; means for receiving a measure of the distance to the target; a processor, for determining the adequate position of the aiming point, based on the distance to the target, and for controlling the light source to emit light so that the aiming point is visualized at the adequate position; wherein the light source is an capable of selectively emitting light in well defined locations on its surface.

The use of said array provides several advantages over prior art, and in one or more embodiments the array is a one-dimensional array. A one-dimensional light-emitting array is in this context defined by a light source capable of emitting light from well-defined points on its surface, along one specific direction. The light-emitting array is a static component in the sense that it remains immovable during the operation of the sight. A static component may be made more robust, as compared to a mobile component serving the same purpose. Further, several other components may be eliminated, such as the drive, suspension, guide means, etc. which are necessary if a mobile light source is used. This elimination reduces overall weight, chock sensitivity, power consumption and, not the least, cost.

The main purpose of the sight is obviously to assist the user in striking the target, and the sight will provide an aiming point to be superimposed on the target. It should be noted that there are other possibilities than to superimpose the aiming point. The aiming point could have another form, such as a crosshair form or a circular form, and these embodiments fall within the scope of the claim. The light-emitting array enables the display of an aiming point, which is movable in a vertical direction, so as to be able to mark an aiming point for various distances to a target.

The position of the aiming point is calculated on basis of the measured distance to the target. Further, the one-dimensional array makes it possible to emit light from several points of the array at the same time, which increases the functionality of the sight. In the case of a miss of the target, the possibility of displaying several aiming points may be useful when correcting the position of the aiming point, e.g. by letting the used aiming point remain on the target while another aiming point is electronically moved the actual point of impact. In this way the processor may correct the calculation of the aiming point so that the next firing will result in a hit.

The processor may include tables and/or algorithms regarding the performance of various types of ammunition. The apparent parameter needed is related to the trajectory for various distances, since the position of the aiming point relies on this type of data. However, the processor enables far more advanced maneuvers, such as correction for wind speed, inclination, air pressure, humidity, corrections etc, and makes the sight very versatile. Therefore, in one or more embodiments the sight may also contain data regarding various types of ammunition, and in such cases this data is included in the acquisition of the position of the aiming point. This acquisition may also include data regarding air speed, air temperature, humidity, and other factors affecting the trajectory of the ammunition, and the choice of aiming point.

In the above context the term "position" relates to the position in a plane orthogonal to the line of sight between the eye of the user and the target. However, in many applications it is also important at what distance from the users eye the image of the lit part, i.e. the aiming point, of the light source is located.

In one or more embodiments the light-emitting array is a two-dimensional array capable of selectively emitting light in well-defined locations on its surface. The two dimensional array makes the sight even more versatile, since it enables the position of the aiming point to be varied in the horizontal direction as well. This makes it possible to correct the position of the aiming point in relation to offsets due to wind, poor alignment etc. The use of a two-dimensional light-emitting array facilitates software tuning of the sight, making the production and quality assurance faster and less costly. When zeroing the weapon it may simply be fired at a target, after which the aiming point is manually (by using input means for communication with the sight) translated to the actual hit, after which the weapon is tuned for that particular type of ammunition. This results in a markedly decrease in ammunition and time consumed during tuning.

The sight according to one or more embodiments may also comprise a range finder, active or passive, within its housing. The use of an integrated rangefinder increases the sights versatility even further. Instead of relying on external data the user may now measure the distance to the target while looking through the sight. The risk of potential misunderstanding decreases and the hit rate is likely to increase. The rangefinder is generally laser based and it should obviously not be subject to any trajectory correction, whereby an aiming point related to the rangefinder may be displayed at all times when the sight is in use.

The optics displaying the aiming point for the user may comprise optics being adapted to create an image of the aiming point which is essentially parallax free relative to the target. An essentially parallax free aiming point significantly simplifies the task of the user, since there is no requirement to align any other components than to simply superimpose the aiming point on the target and fire. If high-trajectory ammunition is used, the sight window through which the user observes the target is generally significantly larger than what is used for a normal telescopic sight since it should allow for a significant inclination of the weapon, and thus of the sight, with maintained visual contact with the target through the sight. An essentially parallax free aiming point is generally created by having the optics generating an image at an infinite distance from the user, or at a typical distance for use, such as 300 m. This also means that the normal human eye may be relaxed, for the benefit of the users ability to concentrate during long time. If the aiming point is located at an infinite distance from the users eye, or 300 m, and the target is located 100 m away, there will be some parallax, though it has no significant impact on the precision of the weapon, as long as the user may still superpose the aiming point on the target while looking in the sight. Due to the fact that targets will be located at various distances a completely parallax free aiming point is very difficult to achieve, which is why the word "essentially" have to be included. For the purpose of this invention "essentially parallax free" optics having inherent very low dependency on distance to observed object with regard to showing little or no parallax effects. When moving the eye over the display the point of impact at the target is not moving essentially more than the movement of the eye.

To further increase the versatility of the sight according to one or more embodiments it may further comprise a gyro for enabling measurement of the inclination of the sight. Combined with the distance being known, a measure of the inclination makes it possible to account for an altitude difference between the sight and the target, and to make the necessary corrections regarding trajectories and the calculated aiming point. The gyro may obviously also include the capability of measuring the direction of the sight in accordance with an established positioning standard, so that the processor of the sight may calculate an absolute position of a target or itself. The gyro may also be used for determining rate of angular change and thereby the speed of the target and aim-off etc. To that end the sight may also comprise a positioning system, such as a Global Navigation Satellite System (GNNS), e.g. Navstar Global Positioning System (GPS) or an alternative positioning system.

A sight according to one or more embodiments may further comprise means for communication with external sources. The means for communication may be realized by regular connectors for keypads, transfer of data etc, and may also comprise means for communication with wireless means, such as a receiver/transmitter for electromagnetic radiation, radio frequency communication, etc. There are several cases when this may constitute an advantage, one example being the sight receiving information regarding wind speed or other atmospheric conditions.

A method for displaying an aiming point for a sight according to one or more described embodiments during targeting with specific ammunition, comprises the main steps conducted during use of the sight:

acquiring distance information representing a distance to a target;

determining a position for imaging the aiming point based on said distance information and trajectory information for ammunition to be used; and controlling light emission from the array to emit light from a position of the surface of the array which via the partially reflective optics images aiming point at the determined position.

In the step related to acquiring distance, may also include acquiring alternative or additional inputs may be used, some examples of which is illustrated in relation to FIG. 2. Further, the step of acquiring distance may include the substeps of:

transmitting electromagnetic radiation towards the target;

receiving a reflection of said electromagnetic radiation from the target; and calculating the distance to the target based on the time elapsed from the transmitting to the receiving.

A computer program for performing the method may be embodied on a computer-readable medium.

DESCRIPTION OF EMBODIMENTS

Figure 1:
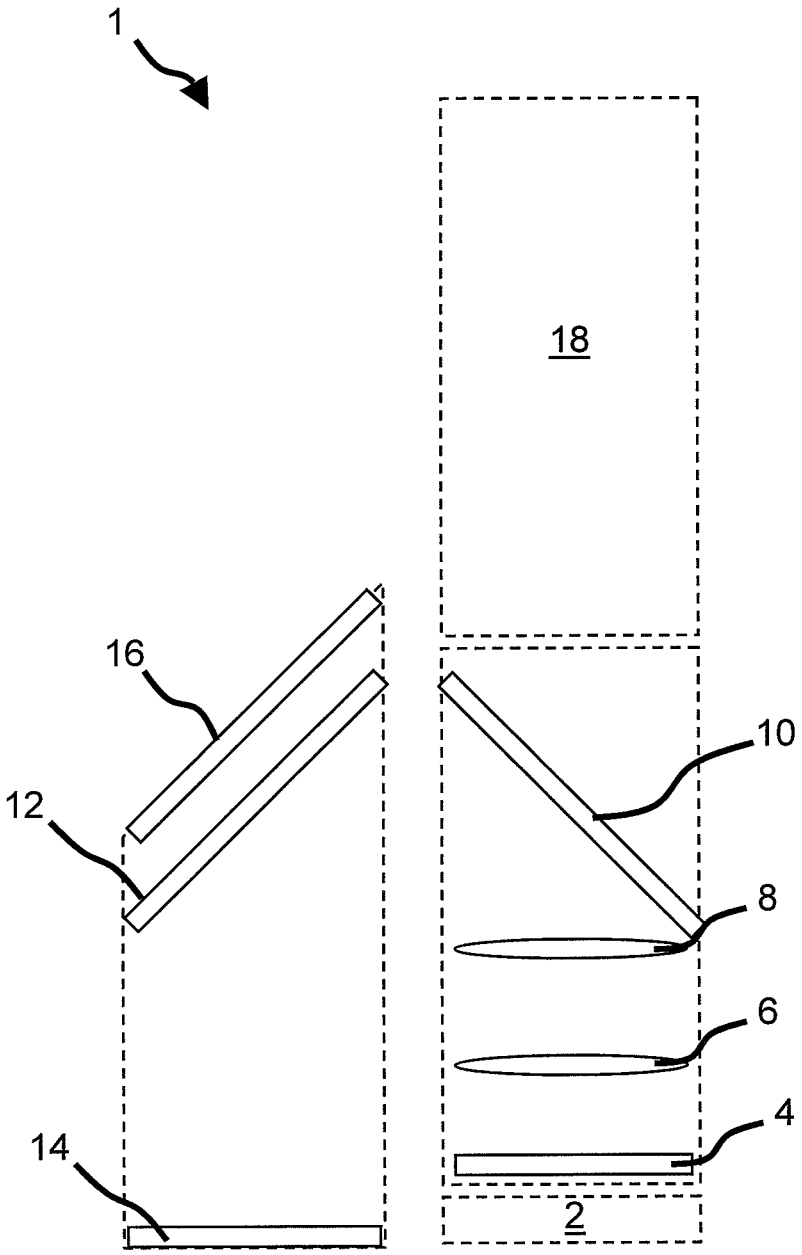
FIG. 1 is a schematic illustration of the sight according to a first embodiment of the invention, in a view from above.

The general structure and function of the inventive sight 1 is described in reference to FIG. 1, which is a schematic representation of the sight, as viewed from above. The general purpose of the sight is to display an aiming point at the correct position. Starting from the lower right the sight has a user input interface 2, directed towards the user (downwards in FIG. 1), with a number of weather protected keypads (not shown in FIG. 1). The optic part of the sight starts with the light-emitting array 4 ("array" in the following), which is capable of emitting light in well-defined locations in a plane orthogonal to the up-down direction of FIG. 1, e.g. by means of light emitting diodes (LEDs), or backilluminated liquid crystal displays, though in the latter case it may be difficult to achieve an adequate light intensity. In one or more embodiments the light-emitting array 4 comprises a two-dimensional diode array close-packed diodes having low power consumption. Such a diode array may be custom-built by PRP Optoelectronics, GB. The wavelength of the emitted light is approximately 650 nm, well within the visible range, yet far enough from wavelength range where the human eye is the most sensitive (around 555 nm). The array 4 is generally fixedly mounted, and has a resolution of 13×178 points and 18 alphanumerical characters, though other resolutions are possible. Following the light path downstream from the array 4 a telescopic lens arrangement comprising two lenses 6 and 8 respectively, follows. The purpose of the telescopic lens arrangement is to image the active parts of the array in a suitable way for the user. The telescopic lens arrangement may be replaced by a single lens, yet the present arrangement is less sensitive and self-compensating in relation to slight distortions in the position of the array or in the light path.

After the telescopic lens arrangement follows a mirror 10. The mirror 10 serves the purpose of deflecting the light path into the second part of the sight. The mirror 10 may be coated so as to reflect light in a narrow wavelength interval, such that basically only light from the array 4 is reflected.

A similar second mirror 12 is arranged in the second part of the sight. This second mirror 12 is coated so as to act as a bandpass filter, transmitting all visible wavelengths but for a narrow wavelength interval including the wavelength emitted by the array 4, which in turn is reflected. Since the light from the array 4 has a wavelength of e.g. 650 nm, most light will be transmitted, and in particular light in a wavelength range where the human eye is most sensitive. The mirror 12 serves the purpose of directing the light path towards the user, permitting the user to observe an image of the active parts of the diode array. The image is a virtual image created at an infinite distance from the user, in order to relax the eye of the user maximally. The user will observe the image through a window 14, and through the same window the target will be observed. A protection window 16 is arranged at the front of the second part of the sight. The protection window can be inclined approximately 45 degrees in order to avoid reflections visible from the target area. Apart from protecting the sight from physical damage, the window 14 may also be coated to prevent transmission of hazardous radiation, such as infrared radiation from laser rangefinders. All optical surfaces may be coated with an anti-reflection (AR) coating to increase transmission. If external reflections are to be avoided the sight may be provided with a "killflash filter".

A third part of the sight houses the optional laser rangefinder 18, which may be of standard type operating at 1550 nm as well as the processing hardware, software and storage capabilities utilized. Other standard wavelengths used are around 900 nm, still in the infrared, and visible light. The latter having the disadvantage of exposing a visible flash of light. The laser rangefinder 18 is operated by the user, and the result of a distance measurement is used as an input to the processing section of the sight. The use of an integrated rangefinder 18 is preferred and preferable features for the rangefinder for the intended application is high reliability and accuracy, low power consumption and low weight. In one or more embodiments the rangefinder may be tailormade by Vectronics, to fulfill the above preferences. These features are also important for the processing hardware, software and storage capabilities utilized. Existing possible microcontrollers include products from Atmel Corporation and Microchip Technology Inc. For other applications the weight and power consumption is less important, and the sight need not be optimized in regard to the above parameters.

Apart from visualizing the aiming point, the array 4 operates as an alphanumerical display, such that it can be used to display current information regarding distance, type of ammunition, etc.

Figure 2:
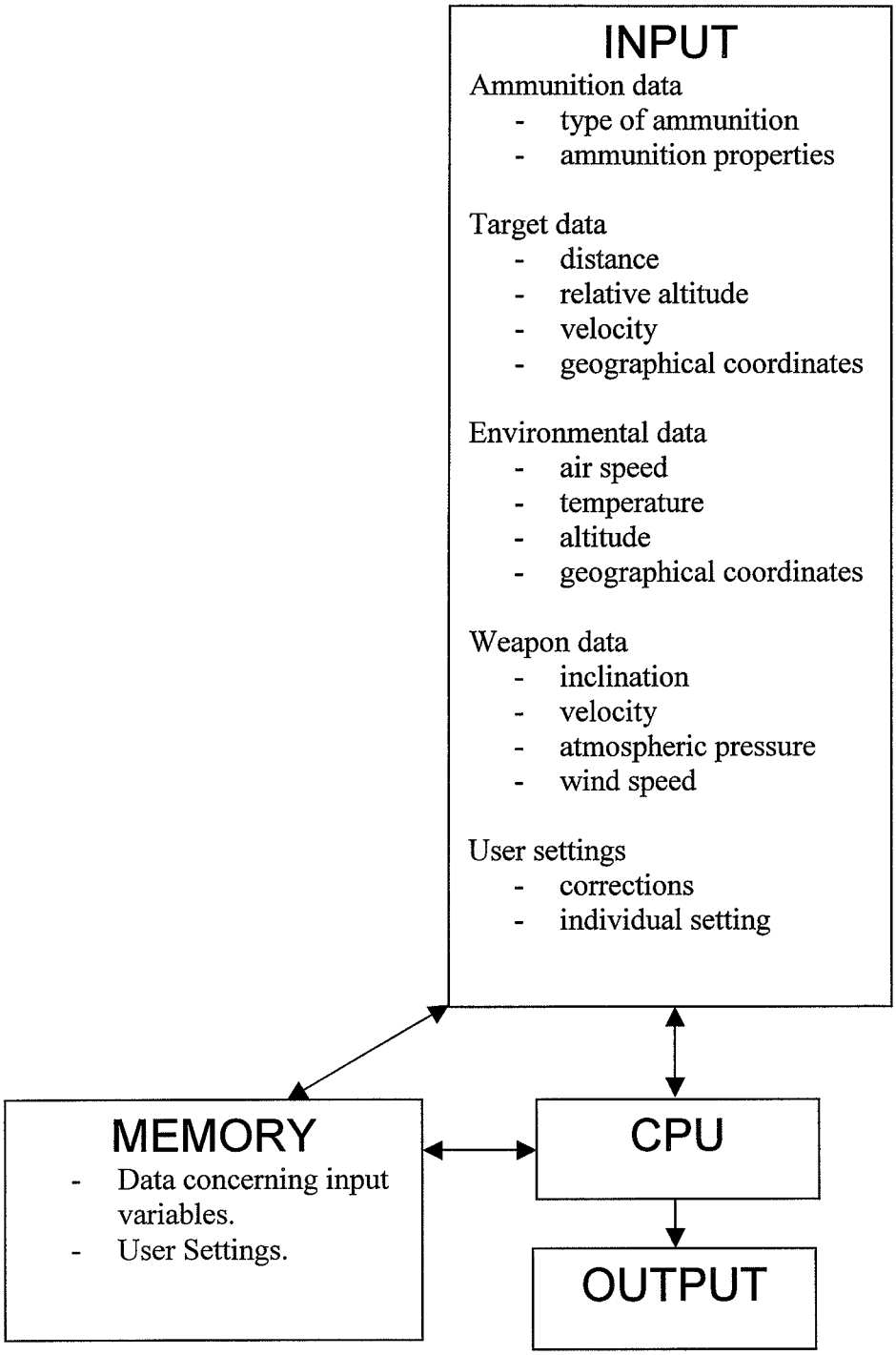
FIG. 2 is a block diagram illustrating the operations performed by the sight of FIG. 1.

FIG. 2 is a block diagram illustrating the processing section of the inventive sight. The block-diagram is a simplified diagram with the purpose of illustrating the operations of the sight 1. In use, data relating to a distance to a target and other optional inputs are transferred to the processor, which uses them in combination with relevant data from the memory to calculate the correct aiming point. A control signal for controlling the light-emitting array is output from the processor, and the light-emitting array starts emitting light from a specific position (one or several) as a result.

The list in input section of FIG. 2 is extensive, and yet non-exhaustive. There are numerous of inputs that may be used for aiding in using the sight, whereof the type of ammunition and the distance to the target are two important inputs. One advantage of the present sight is that its construction allows it to be versatile, and basically any information affecting the trajectory of the ammunition used, or other parameters relevant for the user, may be used by the processor/microcontroller or displayed to the user. This information may also be communicated from the sight to other external units.

The distance to the target is generally measured with the rangefinder, but could also be input by the user, or by the sight receiving information by other means. The same is true for the type of ammunition, which either is detected automatically or input by the user.

The memory contains all information needed to control the sight. Such as tables and algorithms related to ammunition properties. The memory may communicate with external units such as to allow for updates, etc.

Figure 3:
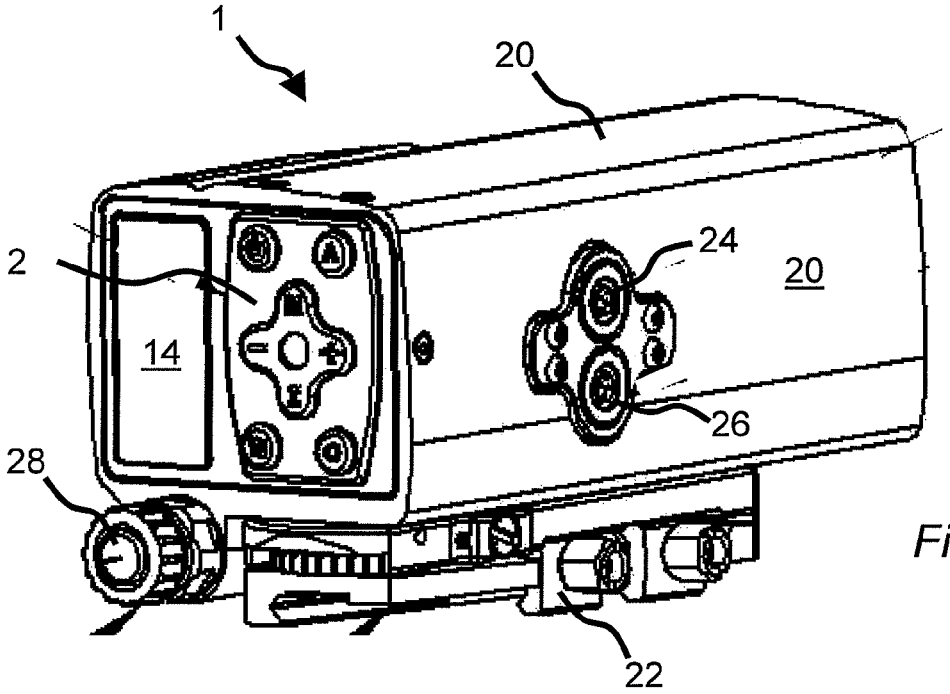
FIGS. 3 and 4 are perspective views of a sight in accordance with an embodiment of the present invention.
Figure 4:
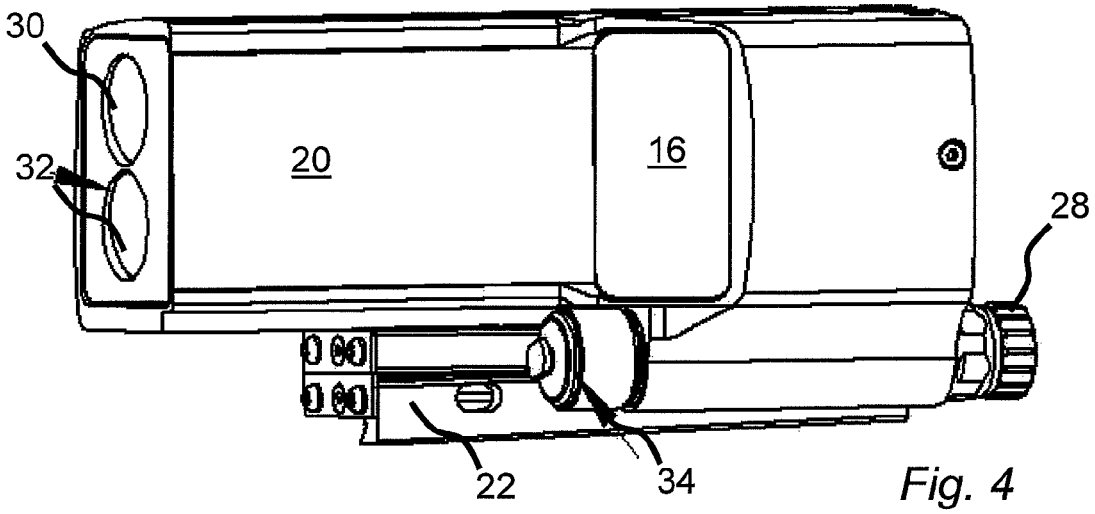

Examples of input variables include, but is not limited to: Ammunition data, type of ammunition, ammunition properties (trajectories coupled to distance, wind speed etc.); Target data, distance, relative altitude, velocity, geographical coordinates; Environmental data, air speed, air temperature, geographical coordinates; Weapon data, inclination, velocity, atmospheric pressure, wind speed, geographical coordinates; User settings, manual inputs, corrections FIGS. 3 and 4 illustrate the sight according to the first embodiment in perspective. By comparison with corresponding reference numbers in FIG. 1 the alignment of the views of FIGS. 3 and 4, respectively, are self-explanatory.

Apart from what has already been described, FIG. 3 illustrates the housing 20. The housing 20 seals and protects the interior from water and impacts. The housing needs to be rigid and durable. In one embodiment it is made of extruded, high strength aluminum, which is anodized, providing a strong, rigid and durable housing with a low weight. There are other alternatives for the housing too, such as reinforced plastics or composite materials. The housing has contact surfaces to other components, such as protection windows etc, and the choice of material is preferably such that the housing and related components have similar properties in relation to heat expansion. If not, it will be difficult to achieve a sight having adequate properties, and the choice of material may be made freely within the boundaries of that the sight preferably fulfills a harsh specification related to temperature, moisture etc.

Further, the mount 22 for mounting the sight to a weapon, e.g. to a picatinny rail, is shown, as well as connections 24, 26 for a remote control (not shown) and charging/communication/auxiliary devices. The remote control may be used to simplify input during shooting, such that the user can aim at a target having the correct shooting position and input data at the same time. The remote control could have a design similar to the keypad 2, or have a simplified design, comprising e.g. buttons for using the rangefinder and correcting the aiming point only. FIG. 3 also illustrates the intensity knob 28, which is a rotary switch used in order to adjust the intensity of the aiming point. Auxiliary devices include a keyboard, a GNSS receiver, a gyro device, device for communication with the ammunition and/or any other element performing functions as demonstrated above with reference to FIG. 2. The auxiliary devices, or other types of external information, may communicate with the sight via a wire or via wire-less communication. Wire-less communication can also occur between the ammunition and the sight, such as information related to timing of the ammunition. Some or all of these devices may also be incorporated into the actual sight. The connections may also be used for downloading new processing software and ammunition tables/algorithms etc.

FIG. 4 shows the sight from a direction such that the lenses 30, 32 for the rangefinder are visible. Opposite to the intensity knob 28, the battery cap 34 is shown. For ease of maintenance the sight preferably uses standard AA batteries for backup. This means that if the internal rechargeable battery fails or there are no opportunities to recharge it, it will be possible to use standard batteries that are used in electrical appliances all over the world.

When using the sight the user has to switch it on and, if it is used for a new purpose, initiate it by setting some user parameters, such as the type of ammunition used, various offsets etc. When looking in the sight the user will then see a static illuminated aiming point, which is used to direct the rangefinder onto a target and zeroed with the rangefinder. When the static illuminated aiming point is superimposed over the target the rangefinder is activated. This action results in that the distance to the target is measured and can be displayed by the alphanumerical display. It can also result in that a second aiming point, e.g. with pulsating intensity, that will be displayed to the user. The user may then have the opportunity to adjust the position of the second aiming point in order to compensate for target movement, wind etc, before superimposing the second aiming point over the target and firing the weapon. After firing the weapon the position of the second aiming point may be adjusted yet again. The second aiming point should preferably differ visually from the first, if displayed at the same time, in order to avoid confusion. The skilled person realizes that this can be achieved in several different ways.

Figure 5:
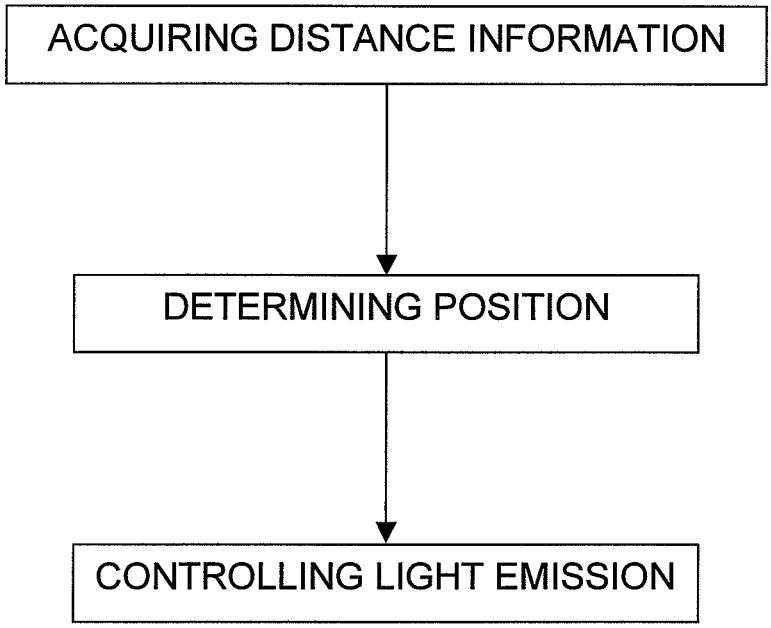
FIG. 5 is a flow chart of a method for displaying an aiming point in a sight in accordance to the invention.
Figure 6:
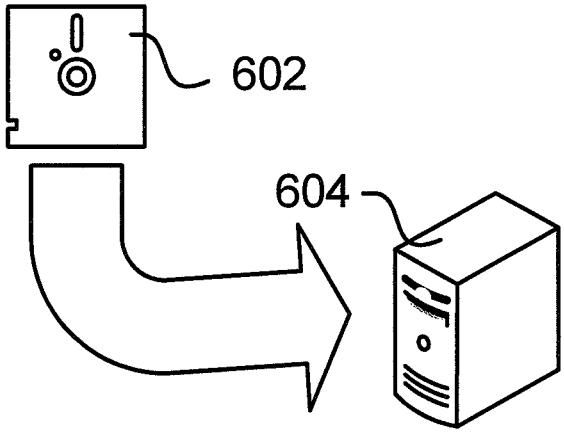
FIG. 6 illustrates a computer program for executing the method of FIG. 5

The method according to the present invention, as illustrated in FIGS. 4 and 5 is suitable for implementation with aid of processing means, such as computers and/or processors. Therefore, there is provided a computer program comprising instructions arranged to cause the processing means, processor, or computer to perform the steps of the method according to any of the embodiments described with reference to FIGS. 1 to 4. The steps are preferably performed by the processing means, processor, or computer in cooperation with physical means, such as those described with reference to any of FIG. 1, 3 or 4, with aid of e.g. an illumination control circuit powering the light source(s) of the array. The computer program preferably comprises program code, as illustrated in FIG. 6, which is stored on a computer readable medium 602, which can be loaded and executed by a processing means, processor, or computer 604 to cause it to perform the method according to the present invention, preferably as any of the exemplary embodiments described with reference to FIGS. 1 to 4. The computer program can for example cause the processor to correct calculated trajectories to account for windage etc.

The computer and computer program can be arranged to execute the program code sequentially where actions of the any of the methods are performed stepwise, or be arranged to execute the program code on a real-time basis where actions of any of the methods are performed upon need and availability of data. The processing means, processor, or computer is preferably what normally is referred to as an embedded system. Thus, the depicted computer readable medium 502 and computer 504 in FIG. 5 should be construed to be for illustrative purposes only to provide understanding of the principle, and not to be construed as any direct illustration of the elements.

The inventive sight has the potential of weighing less than 1000 g, which is half the weight of existing sights with similar technical capabilities. The existing version of the inventive sight, an embodiment with integrated rangefinder, has a weight of 1120 g, including backup battery and mount.

The invention claimed is:

1. A self-compensating weapon sight comprising:

a housing, partially reflective optics, through which a user may observe a target and receive visually displayed information simultaneously, a light source, for visualization of a static illuminated aiming point and a virtual aiming point to the user via the partially reflective optics, wherein the optics displaying the virtual aiming point for the user comprise optics being adapted to create an image of the virtual aiming point which is essentially parallax free relative to the target, a rangefinder adapted to measure the distance to a target when the static illuminated aiming point is superimposed over the target, means for receiving the measure of the distance to the target, a processor, for determining the adequate position of the virtual aiming point, based on the distance to the target, and for controlling the light source to emit light so that the virtual aiming point is visualized at the adequate position, wherein the light source is a light emitting array capable of selectively emitting light in well defined locations on its surface, the weapon sight is capable of visualizing several aiming points simultaneously, wherein the light emitting array provides simultaneous visualization of both the static illuminated aiming point and the virtual aiming point via the partially reflective optics, and the weapon sight is constructed so that the virtual aiming point is superimposed on the target when providing a weapon barrel inclination correction.

2. The sight of claim 1, wherein the light-emitting array is a one-dimensional array capable of selectively emitting light in well defined locations on its surface.

3. The sight of claim 1, wherein the light-emitting array is a two-dimensional array capable of selectively emitting light in well defined locations on its surface.

4. The sight of claim 1, wherein the sight further comprises a range finder within its housing.

5. The sight of claim 1, wherein the sight further comprises a gyro for measuring inclination of the sight.

6. The sight of claim 1, wherein the sight further comprises means for communication with external sources.

7. Method for displaying an aiming point in a self compensating weapon sight, the method comprising:

acquiring distance information representing a distance to a target, wherein the weapon sight comprises:

a housing, partially reflective optics, through which a user may observe the target and receive visually displayed information simultaneously, a light source, for visualization of a static illuminated aiming point and a virtual aiming point to the user via the partially reflective optics, wherein the optics displaying the virtual aiming point for the user comprise optics being adapted to create an image of the virtual aiming point which is essentially parallax free relative to the target, a rangefinder adapted to measure the distance to a target when the static illuminated aiming point is superimposed over the target, means for receiving a measure of the distance to the target, a processor, for determining the adequate position of the virtual aiming point, based on the distance to the target, and for controlling the light source to emit light so that the virtual aiming point is visualized at the adequate position, wherein the light source is a light emitting array capable of selectively emitting light in well defined locations on its surface, the weapon sight is capable of visualizing several aiming points simultaneously, and the weapon sight is constructed so that the virtual aiming point is superimposed on the target when providing a weapon barrel inclination correction;

determining a position for imaging the virtual aiming point based on said distance information and trajectory information for ammunition to be used; and controlling light emission from the light emitting array to emit light from a position of the surface of the light emitting array which via the partially reflective optics images aiming point at the determined position, wherein the light emitting array provides simultaneous visualization of both the static illuminated aiming point and the virtual aiming point via the partially reflective optics.

8. The method according to claim 7, wherein the acquiring of the distance information comprises:

transmitting electromagnetic radiation towards the target;

receiving a reflection of said electromagnetic radiation from the target; and calculating the distance to the target based on the time elapsed from the transmitting to the receiving.

9. The method according to claim 7, further comprising acquiring the trajectory information from any of the group comprising ballistics, inclination, windage, humidity, barometric pressure, position, altitude, geographical coordinates.

10. The method according to claim 7, further comprising controlling the light emission from the array to, via the partially reflective optics, display alphanumerical information.

11. A computer readable medium comprising program code, which when executed by a processor is arranged to cause the processor to perform a method comprising:

acquiring distance information representing a distance to a target, wherein the weapon sight comprises:

a housing, partially reflective optics, through which a user may observe the target and receive visually displayed information simultaneously, a light source, for visualization of a static illuminated aiming point and a virtual aiming point to the user via the partially reflective optics, wherein the optics displaying the virtual aiming point for the user comprise optics being adapted to create an image of the virtual aiming point which is essentially parallax free relative to the target, a rangefinder adapted to measure the distance to a target when the static illuminated aiming point is superimposed over the target, means for receiving a measure of the distance to the target a processor, for determining the adequate position of the aiming point, based on the distance to the target, and for controlling the light source to emit light so that the virtual aiming point is visualized at the adequate position, wherein the light source is an a light emitting array capable of selectively emitting light in well defined locations on its surface, the weapon sight is capable of visualizing several aiming points simultaneously, wherein the light emitting array provides simultaneous visualization of both the static illuminated aiming point and the virtual aiming point via the partially reflective optics, and the weapon sight is constructed so that the virtual aiming point is superimposed on the target when providing a weapon barrel inclination correction;

determining a position for imaging the virtual aiming point based on said distance information and trajectory information for ammunition to be used; and controlling light emission from the array to emit light from a position of the surface of the array which via the partially reflective optics images aiming point at the determined position;

wherein the acquiring of the distance information comprises:

transmitting electromagnetic radiation towards the target;

receiving a reflection of said electromagnetic radiation from the target; and calculating the distance to the target based on the time elapsed from the transmitting to the receiving.

12. The sight of claim 1, wherein the sight is constructed for use with a grenade launcher.

13. The method according to claim 7, wherein the weapon sight is used with a grenade launcher.

14. The medium according to claim 11, wherein the weapon sight is constructed for use with a grenade launcher.

15. The sight of claim 1, wherein the sight does not include optics or electronics distorting a field of view.

16. The sight of claim 1, wherein the sight comprises an inclined protection window disposed at the front of the sight.

17. The method according to claim 7, wherein the weapon sight comprises an inclined protection window disposed at the front of the sight.

18. The medium according to claim 11, wherein the weapon sight comprises an inclined protection window disposed at the front of the sight.

* * * * *